US011686538B2

(12) United States Patent
Edwards et al.

(10) Patent No.: US 11,686,538 B2
(45) Date of Patent: Jun. 27, 2023

(54) CROSS CORRUGATED MEDIA AND RELATED METHOD

(71) Applicant: Brentwood Industries, Inc., Reading, PA (US)

(72) Inventors: Brian Edwards, Reading, PA (US); William Miller, Reading, PA (US)

(73) Assignee: BRENTWOOD INDUSTRIES, INC., Reading, PA (US)

( * ) Notice: Subject to any disclaimer, the term of this patent is extended or adjusted under 35 U.S.C. 154(b) by 0 days.

(21) Appl. No.: 17/261,218

(22) PCT Filed: Nov. 30, 2018

(86) PCT No.: PCT/US2018/063327
§ 371 (c)(1),
(2) Date: Jan. 19, 2021

(87) PCT Pub. No.: WO2020/068143
PCT Pub. Date: Apr. 2, 2020

(65) Prior Publication Data

US 2021/0262741 A1 Aug. 26, 2021

Related U.S. Application Data

(60) Provisional application No. 62/736,135, filed on Sep. 25, 2018.

(51) Int. Cl.
*F28F 3/00* (2006.01)
*F28F 3/02* (2006.01)

(52) U.S. Cl.
CPC ..... *F28F 3/025* (2013.01)

(58) Field of Classification Search
CPC ..... F28F 3/025; F28F 25/08; F28F 25/087; F28F 3/046; F28F 3/048; B01D 46/522;
(Continued)

(56) References Cited

U.S. PATENT DOCUMENTS 3,415,502 A * 12/1968 Munters ..... B01J 19/32 261/DIG. 11
3,952,077 A * 4/1976 Wigley ..... B01J 19/32 261/112.2

(Continued)

FOREIGN PATENT DOCUMENTS

CN 102109297 A 6/2011
CN 202915819 U * 5/2013

(Continued)

OTHER PUBLICATIONS

Internation Search Report and Written Opinion in PCT/US2018/63327 dated Feb. 25, 2019.

(Continued)

*Primary Examiner* — Harry E Arant
(74) *Attorney, Agent, or Firm* — Panitch Schwarze belisario & Nadel LLP

(57) ABSTRACT

A fill pack includes a first sheet and a second sheet. The first sheet has a first end, a second end and a first plurality of flutes. A first microstructure includes first top flat strips, first bottom flat strips and first conduit sides connecting the first top flat strips to the first bottom flat strips. A plurality of first radii connect the first top flat strips to the first conduit sides and the first bottom flat strips to the first conduit sides. The second sheet has a second plurality of flutes. A second microstructure includes second top flat strips, second bottom flat strips and second conduit sides connecting the second top flat strips to the second bottom flat strips. A plurality of second radii connect the second top flat strips to the second conduit sides and second bottom flat strips to the second conduit sides.

21 Claims, 5 Drawing Sheets

(58) Field of Classification Search
CPC ..... B01D 46/525; B01J 2219/3221; B01J 2219/32213; B01J 2219/3222; B01J 19/32; F28D 19/00; F28D 19/044; F28D 17/00
See application file for complete search history.

(56) References Cited

U.S. PATENT DOCUMENTS

| | | | | |
|---|---|---|---|---|
| 4,668,443 | A | 5/1987 | Rye | |
| 5,013,492 | A | 5/1991 | Gay et al. | |
| 5,124,087 | A | 6/1992 | Bradley et al. | |
| 5,217,788 | A | 6/1993 | Rye | |
| 6,544,628 | B1 | 4/2003 | Aull et al. | |
| 6,640,427 | B2 | 11/2003 | Aull et al. | |
| 6,877,205 | B2 | 4/2005 | Aull et al. | |
| 7,674,304 | B2 | 3/2010 | Krell et al. | |
| 8,690,130 | B2 | 4/2014 | Kulick, III et al. | |
| 9,758,406 | B2 | 9/2017 | Kulick, III | |
| 2010/0078379 | A1* | 4/2010 | Rocklitz ..... | B01D 35/005 210/493.1 |
| 2010/0159209 | A1 | 6/2010 | Mockry et al. | |
| 2014/0053926 | A1 | 2/2014 | Kulick, III et al. | |
| 2017/0003078 | A1 | 1/2017 | Vadder et al. | |
| 2018/0299210 | A1* | 10/2018 | Ronacher ..... | F28F 3/027 |

FOREIGN PATENT DOCUMENTS

| | | | | |
|---|---|---|---|---|
| CN | 202915819 | U | | 5/2013 |
| CN | 103604312 | A | | 2/2014 |
| CN | 104266533 | A | * | 1/2015 |
| CN | 104266533 | A | | 1/2015 |
| CN | 205317071 | U | | 6/2016 |
| CN | 106334284 | B | | 5/2018 |
| DE | 4127245 | A1 | | 2/1993 |
| TW | I558565 | B | | 11/2016 |
| ZA | 964391 | B | | 12/1996 |

OTHER PUBLICATIONS

European Search Report dated Jun. 23, 2022 in European Application No. 18 93 5429.

* cited by examiner

CROSS CORRUGATED MEDIA AND RELATED METHOD

CROSS-REFERENCE TO RELATED APPLICATIONS

The present application is a Section 371 of International Application No. PCT/US2018/063327, filed Nov. 30, 2018 and titled, "Cross Corrugated Media and Related Method" and claims the benefit of U.S. Provisional Patent Application No. 62/736,135, filed on Sep. 25, 2018 and titled "Cross Corrugated Media and Related Method" the entire contents of which are incorporated herein by reference in their entirety.

BACKGROUND OF THE INVENTION

Cross corrugated media or fill has been a standard product in the cooling tower and trickling filter markets for decades and may also be utilized in oil/water separation, bio-towers, nitrification towers, demisters and related systems and markets. The cross corrugated media product has undergone few changes to the general configuration since its earliest configurations and has become a commodity for these markets. Basic changes such as limited microstructure features and dedicated glue bonds are relatively recent, minor changes to the cross corrugated media product. The cross corrugated media product is not differentiated by manufacturers in these markets nor is its design typically modified for these different applications, such as oil/water separation, bio-towers, nitrification towers, demisters.

Specific to the cooling tower industry, it would be advantageous to differentiate the cross corrugated media product based on the ability to retrofit a new product that meets the application requirements, improves existing tower performance capacity, and reduces the size of new cooling tower designs based on improved tower performance. One of the ways that a cooling tower performance can be characterized is by comparing the amount of fan horsepower required to meet its intended operating conditions. An improvement to overall performance of the cooling tower by replacing original, traditional cross corrugated media with replacement cross corrugated media that improves performance would be advantageous to fill manufacturers and the tower owner. In addition, improving overall performance of the cooling tower by designing and installing a tower that is smaller and has the same or improved performance when compared to the existing tower would be advantageous to fill manufacturers and tower owners.

The typical design of a cross corrugated fill includes a simple cross corrugated trapezoidal flute geometry with linear sidewalls in the trapezoid. These fill products have features or "microstructure" that are designed to increase the surface area of the fill and to mix the water film flowing over the surface of the microstructure in the fill. The increased surface area exposes a greater amount of the water film to the airflow in the film. Since fill thermal performance is dependent upon having increased mass transfer rates of water into the air stream, changes to microstructure may provide a benefit; however, any changes to the microstructure that result in pressure drop across the assembled fill products may reduce overall tower performance.

An aspect in design performance of a cross corrugated fill is to promote full distribution of water on the surface of the fill sheets. Full distribution of water on the surface increases the effective surface area of the water in contact with the air and enables higher mass transfer efficiencies. The tradeoff of full water distribution is typically the pressure drop generated by the changes to the surface and, in practice, the overall performance does not change significantly as the higher thermal performance is offset by the increased horsepower to overcome the change in pressure drop or a reduced airflow for the same horsepower is realized.

The capacity of the cooling tower is dependent on the amount of air passing though the fill. It would be advantageous to further reduce the pressure drop for a particular fill so that the existing horsepower fan provides more mass flowrate of air through the fill. This increased air flow through the tower typically enables the unit to achieve colder outlet water temperature or to cool a larger mass of water for a given set of operating conditions.

It would be advantageous to design, construct and deploy a cross corrugated media or fill that maintains a lower pressure drop with an increase in thermal performance over known fill products. The preferred embodiment of the cross corrugated media and fill packs address the disadvantages of the prior art media and fill by balancing pressure drop with increased surface area of the microstructure for particular operating conditions and applications.

BRIEF SUMMARY OF THE INVENTION

Briefly stated, the preferred invention is directed to a cross corrugated fill pack assembly for cooling a fluid flowing through the pack with a gas flowing through the pack in a substantially opposing direction. The cross corrugated fill pack assembly includes a first sheet and a second sheet. The first sheet defines a longitudinal axis and has a first end, a second end and a first plurality of flutes extending from the first end toward the second end. A first microstructure is defined on the first sheet including first top flat strips, first bottom flat strips and first conduit sides connecting the first top flat strips to the first bottom flat strips. A plurality of first radii connect the first top flat strips to the first conduit sides and the first bottom flat strips to the first conduit sides. The first plurality of flutes extends at a first flute angle relative to the longitudinal axis. The first flute angle is approximately zero to forty-five degrees. The second sheet has a second plurality of flutes. A second microstructure is defined on the second sheet including second top flat strips, second bottom flat strips and second conduit sides connecting the second top flat strips to the second bottom flat strips. The first and second microstructure is generally arcuate or wavy in both longitudinal and lateral directions of the fill pack assembly or preferably forming sinusoidal-like waves along nearly any cross-section taken of the microstructure. In addition, the macrostructure or flutes that carry the microstructure 12 are also preferably angularly shaped in their cross-section defining a substantially sinusoidal-like wave taken along a line substantially perpendicular to the longitudinal direction of the flutes, as is shown in FIG. 5, which is in contrast to typical trapezoidal-shaped flutes in known sheets. A plurality of second radii connect the second top flat strips to the second conduit sides and second bottom flat strips to the second conduit sides. The first sheet is connected to the second sheet in an assembled configuration with the first plurality of flutes extending to an opposite side of the longitudinal axis relative to the second plurality of flutes in the assembled configuration.

In another aspect, the preferred invention is directed to a cross corrugated fill pack assembly for cooling a fluid flowing through the pack with a gas flowing through the pack in a substantially opposing direction. The cross corrugated fill pack assembly includes a first sheet and a second sheet. The first sheet defines a longitudinal axis and has a first end, a second end and a first plurality of flutes extending from the first end toward the second end. A first microstructure is defined on the first sheet including first top flat strips, first bottom flat strips and first conduit sides connecting the first top flat strips to the first bottom flat strips. A plurality of first radii connect the first top flat strips to the first conduit sides and the first bottom flat strips to the first conduit sides. The first plurality of flutes extends at a first flute angle relative to the longitudinal axis. The first flute angle is approximately zero to forty-five degrees. The second sheet has a second plurality of flutes. A second microstructure is defined on the second sheet including second top flat strips, second bottom flat strips and second conduit sides connecting the second top flat strips to the second bottom flat strips. A plurality of second radii connect the second top flat strips to the second conduit sides and second bottom flat strips to the second conduit sides. The first sheet is connected to the second sheet in an assembled configuration with the first plurality of flutes extending to an opposite side of the longitudinal axis relative to the second plurality of flutes in the assembled configuration.

In yet another aspect, the preferred invention is directed to a fill sheet for assembly into a fill pack for cooling a cooling medium in a cooling tower. The fill sheet includes a first end and a second end extending substantially parallel to the first end and generally perpendicularly relative to a longitudinal axis. The first and second ends extend substantially parallel to a lateral axis of the fill sheet. A plurality of flutes extends from the first end toward the second end at a first flute angle. Microstructure is defined on the plurality of flutes. The microstructure includes first top flat strips, first bottom flat strips and first conduit sides connecting the first top flat strips to the first bottom flat strips. A plurality of first radii connect the first top flat strips to the first conduit sides and the first bottom flat strips to the first conduit sides.

BRIEF DESCRIPTION OF THE SEVERAL VIEWS OF THE DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
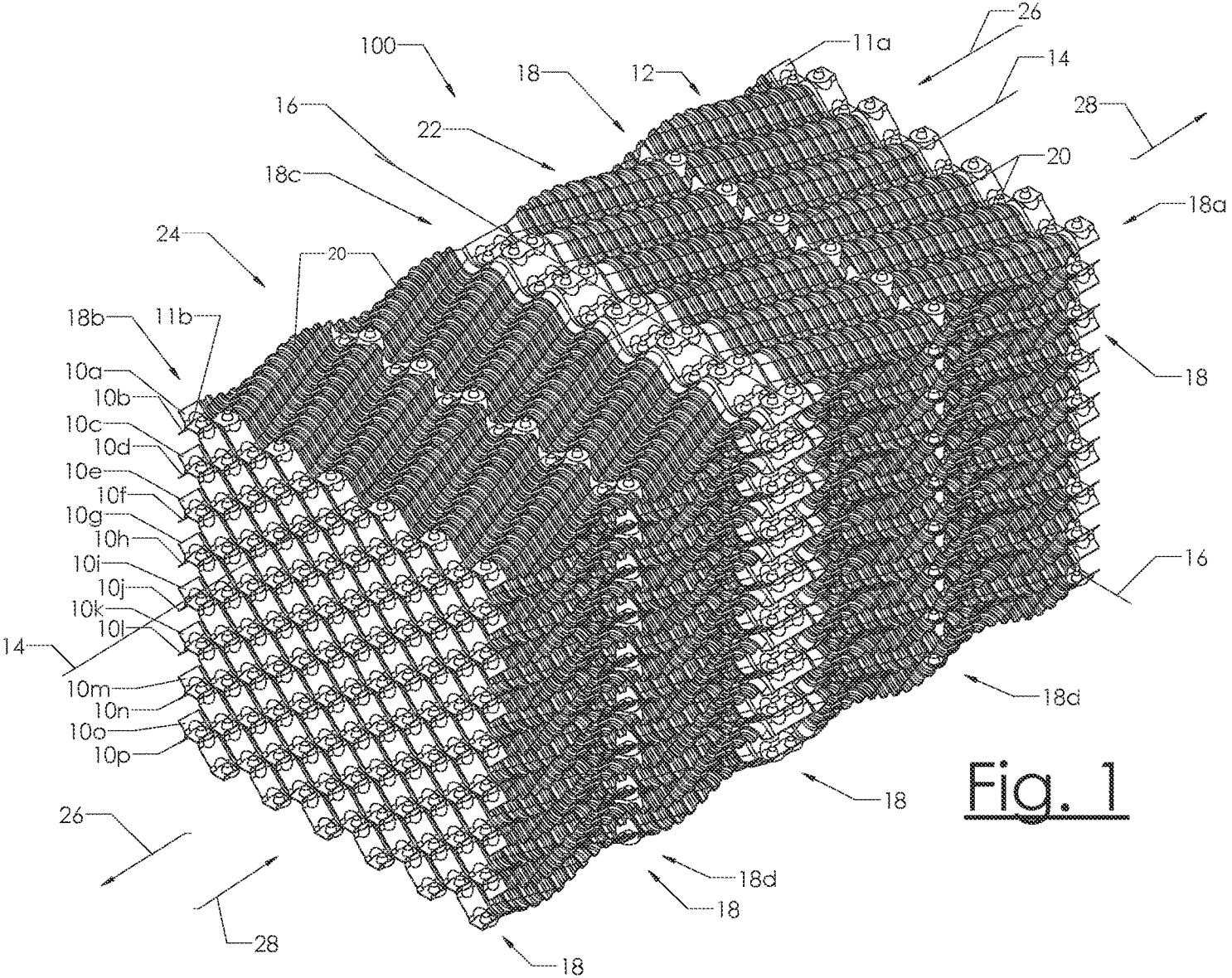
FIG. 1 is a top perspective view of a cross corrugated media or fill pack or assembly in accordance with a preferred embodiment of the present invention.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center of the fill pack and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-4, the preferred invention is directed to a cross corrugated media, fill pack or assembly, generally designated 100. The cross corrugated media, fill pack or assembly 10 is preferably comprised of a plurality of stacked and engaged fill sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p*. In the first preferred embodiment, the cross corrugated media or fill pack 100 includes sixteen (16) stacked and engaged fill sheets, which include first, second, third, fourth, fifth, sixth, seventh, eighth, ninth, tenth, eleventh, twelfth, thirteenth, fourteenth, fifteenth and sixteenth fill sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p*, but is not so limited and may be comprised of two (2) or more sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p* that are stacked and engaged to define the cross corrugated media or fill 100. The cross corrugated media or fill 100 and each of the sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p* define a longitudinal axis 14 extending generally longitudinally and a lateral axis 16 extending generally laterally relative to the sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p*. The air and water flow through the fill pack 100 is generally along the longitudinal axis 14 between first and second ends 11*a*, 11*b* of the sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p*. The fill sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p* are generically described herein using the reference number 10.

Each of the sheets 10 has a flute height $H_f$ of approximately nineteen millimeters (19 mm) in the preferred embodiment, but is not so limited and may have smaller or greater flute heights $H_f$ depending on design parameters and preferences. The flute height $H_f$ may, for example, be in a range of approximately five to thirty millimeters (5-30 mm) for various configurations and applications. A first sheet 10*a* of the sheets 10 is shown as a representative example of the sheets 10 in FIGS. 2-4, but may be comprised of any of the plurality of sheets 10*a*, 10*b*, 10*c*, 10*d*, 10*e*, 10*f*, 10*g*, 10*h*, 10*i*, 10*j*, 10*k*, 10*l*, 10*m*, 10*n*, 10*o*, 10*p* located at nearly any position within the corrugated media or fill 100, as would be understood by one having ordinary skill in the art upon reviewing the present disclosure. Each of the sheets 10 includes the first end 11*a* and the second end 11*b* between which air and water flow through the fill pack 100 during operation in an airflow direction 28, with each successive sheet 10 in the pack 100 being rotated one hundred eighty degrees (180°) relative to an adjacent sheet 10 to define the cross corrugation of the pack 100. The first end 11*a* extends substantially parallel to the second end 11*b* and generally perpendicular relative to the longitudinal axis 14. The first and second ends 11*a*, 11*b* extend substantially parallel to the lateral axis 16. The preferred fill pack 100, accordingly, includes alternating first and second ends 11*a*, 11*b* through its thickness to define the cross corrugation of the fill pack 100. The fill or pack 100 is not limited to such configurations with each sheet 10 being rotated substantially one hundred eighty degrees) (180°) relative to an adjacent sheet 10 in the fill pack 100 and may be otherwise configured, such as each sheet 10 is not rotated relative to an adjacent sheet 10 or such that each sheet 10 is rotated at another angle relative to adjacent sheets 10 depending on various design considerations and designer and performance preferences.

Each sheet 10 of the preferred cross corrugated media or fill 100 includes a first portion 22 and a second portion 24. The first portion 22 extends between a central row of connectors 18*c* and the first end 11*a* and the lower portion 24 extends between the central row of connectors 18*c* and the second end 11*b*. The sheets 10 are not limited to including the first and second portions 22, 24 and may be comprised of a single portion, such as the first portion 22, which is the upper portion of the first sheet 10*a*, or the second portion 24, which is the lower portion on the first sheet 10*a*, or may include additional portions connected or integrally formed with the first and second portions 22, 24, depending on designer preferences, preferred functions, size limitations or other factors. In the preferred embodiment, the plurality of flutes 20 includes a first plurality of flutes 20 on the first portion 22 and a second plurality of flutes 20 on the second portion 24, wherein the first plurality of flutes 20 extend at a first flute angle $\Delta_{f1}$ and the second plurality of flutes 20 extend at a second flute angle $\Delta_{f2}$. The first portion 22 is preferably separated from the second portion 24 by the central row of connectors 18*c* that extends generally parallel to the lateral axis 16. The flute angle $\Delta_f$ is generically identified by reference character $\Delta_f$, although the flutes 20 extend substantially at the same flute angle $\Delta_f$ in the preferred embodiment, with the flutes 20 of the second portion 24 extending at an opposite side of the longitudinal axis 14 relative to the flutes 20 of the first portion 22, thereby defining the cross corrugated configuration of the preferred fill pack 100, as is described in further detail herein.

In the preferred embodiment, the sheets 10 include flutes or corrugations 20 that guide airflow through the first and second portions 22, 24 and between the first and second ends 11*a*, 11*b* in an airflow direction 28. The flutes 20 define a first flute angle $\Delta_n$ in the first portion 22 and a second flute angle $\Delta_{f2}$ in the second portion 24. The first and second flute angles $\Delta_{f1}$, $\Delta_{f2}$ are approximately the same twenty degrees (20°) in the preferred embodiment, compared to a typical thirty degree (30°) flute angle for prior art cross corrugated media or fill, to reduce the fill pressure drop created by the flute macro-geometry as the air flows between the first end 11*a* and the second end 11*b* in the airflow direction 28. This reduced first and second flute angles $\Delta_{f1}$, $\Delta_{f2}$, as well as the arcuate and undulating shape of the microstructure 12, reduces pressure drop from the macrostructure flute geometry and enables more pressure drop to be attributed to the microstructure 12 of the cross corrugated media or fill pack 100 to improve thermal performance of the fill pack 100 over typical media or fill, for example, a Brentwood Industries CF1900 cross-fluted film fill. The CF1900 fill has limited microstructure which is defined by features that are physically cut into a mold to produces the CF1900. The features are cut into the mold with a ball mill to a relatively shallow depth and the sheets of the CF1900 fill pack take on the shapes milled into the mold during production. The microstructure of the CF1900 is also discrete and spaced relatively widely apart on the surface of the CF1900 corrugated fill sheet. The flutes 20 in the first portion 22 of the sheets 10 preferably extend in a first direction relative to the longitudinal axis 14 and the flutes 20 in the second portion 24 preferably extend in a second opposite direction relative to the longitudinal axis 14, but are not so limited and may be comprised of different angles and extend in substantially the same direction relative to the longitudinal axis 14 or may be otherwise configured based on designer preferences, functional purposes or based on other factors. The first microstructure 20 of the first sheet 10*a* and the remaining microstructure 20 of each of the sheets 10, defines generally arcuate surfaces between the first top flat strips 12*bt* and the first bottom flat strips 12*bb* along which the fluid flows during operation between the first and second ends 11*a*, 11*b* in the water flow direction 26.

The sheets 10 are preferably connected to each other along the rows of connectors 18 to define the assembled fill 10. The rows of connectors 18, which are generically identified by reference number 18, preferably include a first end row 18*a* proximate the first end 11*a*, a second end row 18*b* proximate the second end 11*b*, the central row 18*c* preferably centrally located between the first and second ends 11*a*, 11*b* and two intermediate rows 18*d* positioned between the first end 11*a* and the central row 18*c* and between the second end 11*b* and the central row 18*c*, respectively. The connectors 18, including the first end row 18*a*, the second end row 18*b*, the central row 18*c* and the intermediate rows 18*d*, are not limited to being positioned at the described locations or having the configurations shown in the attached drawings, but preferably are designed and configured to align and connect the sheets 10 into the fill pack 100, such as by crush locking, fastening, clamping, adhesive bonding or other connecting mechanisms or approaches. In the preferred embodiment, the first sheet 10*a* is connected to the second sheet 10*b* in an assembled configuration with the first plurality of flutes 20 of the first sheet 10*a* extending to an opposite side of the longitudinal axis 14 relative to the second plurality of flutes 20 of the second sheet 10*b* in the assembled configuration and the first end 11*a* of the first sheet 10*a* is positioned proximate the second end 11*b* of the second sheet 10*b*. In addition, the third sheet 10*c* is preferably connected to the second sheet 10*b* with the third plurality of flutes 20 of the third sheet 10*c* extending to an opposite side of the longitudinal axis 14 relative to the second plurality of flutes 20 of the second sheet 10*b*. Likewise, the remaining fourth, fifth, sixth, seventh, eighth, ninth, tenth, eleventh, twelfth, thirteenth, fourteenth, fifteenth and sixteenth sheets 10*d*, 10*e*, 10*f*, 10*g*, 10*h*, 10*i*, 10*j*, 10*k*, 10*l*, 10*m*, 10*n*, 10*o*, 10*p* are preferably connected to their adjacent sheets 10*d*, 10*e*, 10*f*, 10*g*, 10*h*, 10*i*, 10*j*, 10*k*, 10*l*, 10*m*, 10*n*, 10*o*, 10*p* such that the flutes 20 extend to an opposite side of the longitudinal axis 14, respectively. The fill pack 100 is not limited to such arrangements, for example, the flutes 20 may extend generally parallel to the longitudinal axis 14, offsets (not shown) may be utilized or other methods may be utilized to configure the adjacent sheets 10. The offsets, particularly if designed to have no contact between corrugations or flutes 20 along their lengths as they extend from the first end 11*a* toward the second end 11*b* in the assembled configuration at the flute angle $\Delta_f$, also reduce pressure drop, by eliminating a complete block to airflow created when portions of the flutes 20 of adjacent sheets 10 in the fill pack 100 contact each other along their length.

The microstructure 12 of each sheet 10 of the preferred cross corrugated media or fill 100 includes relatively deep, undulating, and continuous structure. The microstructure 12 preferably extends substantially parallel to the lateral axis 16 and the first and second ends 11*a*, 11*b*, but is not so limited and may extend at an angle relative to the lateral axis 16 or may be configured in a Chevron-like shape. The preferred microstructure 12 allows water to spread across the width or across the lateral axis 16 and along the length or along the longitudinal axis 14 of the sheets 10 during use for improved distribution of water on the fill sheets 10. The relatively deep, arcuate and continuous horizontal microstructure 12 facilitates use of substantially all surface area of the sheets 10 as heat transfer surfaces within the fill pack 100. As the water flows down the assembled fill sheets 10, the microstructure 12 constantly redirects the water if channeling or pooling occurs to promote a consistent film of water across the width of the sheets 10. The microstructure 12 comprises essentially the entire surface of the fill sheets 10, with the exception of rows of connectors 18, 18*a*, 18*b*, 18*c*, 18*d* that extend substantially parallel to the lateral axis 16. The sheets 10 are not limited to including each of the first end, second end, central and intermediate rows of connectors 18*a*, 18*b*, 18*c*, 18*d*, but preferably include the first and second end rows 18*a*, 18*b* that extend along the first and second ends 11*a*, 11*b*. The connectors 18 are preferably configured to secure the sheets 10 together in the fill pack 100 and may include any number of connectors 18 at nearly any desired location on the sheets 10 to facilitate connection of the sheets 10 into the fill pack 100. The connectors 18 are preferably designed, depending on the particular application and designer preferences, to facilitate secure engagement of the sheets 10 in the packs 100. With the arcuate undulating microstructure 12 of the preferred embodiment, the obstruction to vertical water flow generally along the longitudinal axis 14 from the first end 11*a* to the second end 11*b* may create a thicker film on top of the horizontal microstructure 12 and facilitates distribution of the water film laterally fully across the width of the sheets 10 in the fill pack 100, thereby enabling consistent water film distribution and flow of water in a water flow direction 26.

Performance of the cross corrugated fill described in German Patent Application No. DE 41 27 245, filed Aug. 17, 1991 and titled, "Heat Exchanger for Cooling Tower—has Elements with Zigzag Grooved for Flow of Water in Opposite Direction to Flow of Gat" ("245-APP") was tested and compared to the CF1900. The fill sheets constructed in accordance with the 245-APP have sharp-edged transitions between conduit sides and flat strips of the microstructure of the surface elements or sheets 1. The 245-APP states, "this fine profile extends to the direction of the channel profile at an angle which corresponds approximately to the angle of inclination of the channels to the main flow direction of gas and liquid. The resulting, approximately horizontal run of the fine profiling in the installed state causes the liquid is held on the edge of the channels within the respective flow channel and despite the oblique channel course does not leave the channel edge." As a result of the sharp transitions, turbulence is produced in the film of liquid at a transition from a profile peak to a profile trough, or from a profile trough to a profile peak, which promotes heat exchange and mass transfer. The pressure drop of a pack of sheets constructed in accordance with the 245-APP was higher than that of the CF1900, even though the flute angle was reduced, although the thermal performance also increases. The overall performance of the fill constructed in accordance with the 245-APP was lower than the existing CF1900, due to the significant increase in pressure drop which was not offset by the increased thermal performance.

Figure 4:
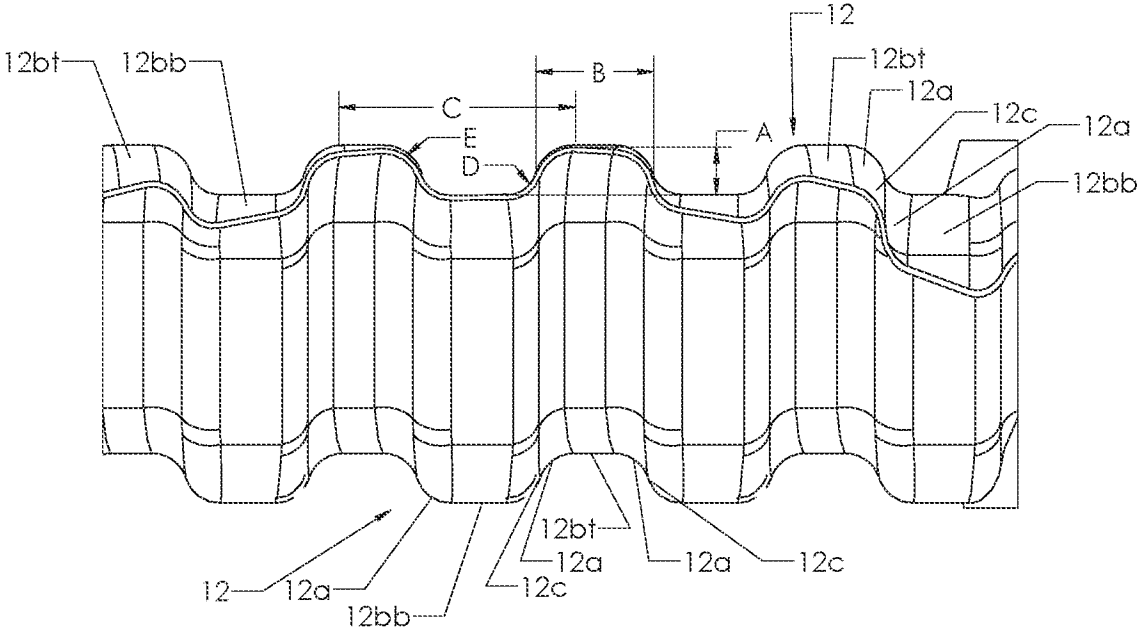
FIG. 4 is a magnified cross-sectional view of the first sheet of FIG. 2, taken from within shape 4 of FIG. 3.

In the preferred cross corrugated fill packs 100, the fill sheets 10 include fillets or radii 12*a* added to the microstructure 12 to provide arcuate structures where, in contrast, sharp corners are present on the horizontal microstructure of the sheets constructed in accordance with the 245-APP. As is shown in FIG. 4, the radii 12*a* are specifically formed at transitions between top and bottom flat strips 12*b* at peaks and valleys of the preferred microstructure 12 and conduit sides 12*c* that extend between the flat strips 12*b*. The conduit sides 12*c* of the preferred microstructure 12 is substantially an inflection line 12*c* between the radii 12*a* transitioning between adjacent flat strips 12*b* or the top flat strip 12*bt* and the bottom flat strip 12*bb*, but is not so limited and may be comprised of a flat or otherwise shaped portion, depending on designer preferences, the size of the microstructure 12, functional considerations or other factors. The first conduit side or inflection line 12*c* of the first sheet 10*a* is preferably positioned between a first radius 12*a* and a second radius 12*a* of the plurality of first radii 12*a* that connect the first flat top strip 12*bt* to the first bottom flat strip 12*bb*. The preferred cross corrugated fill pack 100 was also tested and the results showed that not only was pressure drop lower during operation, but the thermal performance remained the same or increased in at least one case over the cross corrugated pack constructed in accordance with the 245-APP with the sharp transitions in the microstructure. This was unexpected as a decrease in pressure drop is usually accompanied by a reduction in thermal performance. The resulting preferred fill pack 100 constructed with the preferred sheets 10, therefore, has significantly lower pressure drop for at least the same or higher thermal performance and a significantly higher overall tower performance as compared to the standard CF1900 product and the packs constructed in accordance with the 245-APP, as seen in below Table 1.

The first sheet 10*a* includes a first microstructure 12 including first top flat strips 12*bt*, first bottom flat strips 12*bb* and first conduit sides 12*c* connecting the first top flat strips 12*bt* to the first bottom flat strips 12*bb*. The first sheet 10*a* also includes a plurality of first radii 12*a* connecting the first top flat strips 12*bt* to the first conduit sides 12*c* and the first bottom flat strips 12*bb* to the first conduit sides 12*c*. The first plurality of flutes 20 extend at the first flute angle $\Delta_{f1}$ relative to the longitudinal axis 14. The first flute angle $\Delta_{f1}$ is approximately zero to forty-five degrees, but is not so limited and may be fifteen to thirty degrees (15-30°) and twenty degrees (20°) in the preferred embodiment.

The second sheet 10*b* a second plurality of flutes 20 and a second microstructure 12 defined on the second sheet 10*b*. The additional sheets 10 also include flutes 20 and microstructure 12 and are designed and configured substantially the same as the first and second sheets 10*a*, 10*b*. The microstructure 12 of the second sheet 10*b* includes second top flat strips 12*bt*, second bottom flat strips 12*bb* and second conduit sides 12*c* connecting the second top flat strips 12*bt* to the second bottom flat strips 12*bb*. A plurality of second radii 12*a* connect the second top flat strips 12*bt* to the second conduit sides 12*c* and the second bottom flat strips 12*bb* to the second conduit sides 12*c*. The first sheet 10*a* is connected to the second sheet 10*b* in an assembled configuration with the first plurality of flutes 20 extending to an opposite side of the longitudinal axis 14 relative to the second plurality of flutes 20 in the assembled configuration. The first sheet 10*a* is preferably connected to the second sheet 10*b* in the fill pack 100 such that the first end 11*a* of the first sheet 10*a* is positioned proximate the second end 11*b* of the second sheet 10*b* so that the flutes 20 are in a cross corrugated configuration with the second sheet 10*b* rotated approximately one hundred eighty degrees relative to the first sheet 10*a*. In the preferred embodiment, the first sheet 10*a* includes a first end row of connectors 18*a* extending along the first end 11*a* and a second row of connectors 18*b* extending along the second end 11*b*. The second sheet 10*b* also includes a first end row of connectors 18*a* at the first end and a second end row of connectors 18*b* extending along the second end such that the first end row of connectors 18*a* of the first sheet 10*a* are connected to the second end row of connectors 18*b* of the second sheet 10*b* and the second end row of connectors 18*b* of the first sheet 10*a* are connected to the first end row of connectors 18*a* of the second sheet 10*b* in the assembled configuration of the fill pack 100. The central row of connectors 18*c* of the first and second sheets 10*a*, 10*b* and the aligned intermediate rows of connectors 18*d* of the first and second sheets 10*a*, 10*b* are also attached in the fill pack 100. In the preferred embodiment, the first and second end rows of connectors 18*a*, 18*b*, the central row of connectors 18*c* and the intermediate rows of connectors 18*d* are comprised of a plurality of connector tabs.

Referring to Table 1, the fan horsepower was determined to achieve the same cold water temperature during testing of each of the CF1900 cross corrugated fill, the cross corrugated fill constructed in accordance with the 245-APP and the preferred cross corrugated fill pack 100. The density and height of the microstructure were increased over the baseline CF1900 and for the packs constructed in accordance with the 245-APP with the sharp microstructures, but the product configuration of the preferred fill pack 100 was substantially the same except for the fillets 12*a* included between the flat strips 12*b* and the conduit sides 12*c*, which are substantially comprised of an inflection line between the adjacent fillets 12*a* of the preferred sheets 10. Because of the higher thermal performance or efficiency of the preferred cross corrugated fill pack 100, the required airflow was reduced also lending itself to lower required fan horsepower and higher overall tower performance. As is shown below in Table 1, in each of the scenarios, the preferred cross corrugated fill packs 100 function at a lower fan power percentage than the CF-1900 fill packs and the 245-APP fill packs to achieve the same cold water temperature, functioning at between seven and seven tenths to thirty-five and eight tenths percent (7.7-35.8%) less fan power than the fill packs constructed in accordance with the teachings of the 245-APP.

TABLE 1

Tower Performance Comparison

| | | | | | | |
|---|---|---|---|---|---|---|
| Inlet WB Temperature | 78 | 78 | 78 | 78 | 78 | 78 |
| Cold Water Temperature | 83 | 85 | 87 | 83 | 85 | 87 |
| Fill Height | 6 | 6 | 6 | 4 | 4 | 4 |
| CF-1900 (% Fan Power) | 100.0 | 100.0 | 100.0 | 100.0 | 100.0 | 100.0 |
| 245-APP (% Fan Power) | 121.3 | 115.8 | 111.0 | 102.9 | 100.3 | 97.8 |
| Preferred Embodiment (% Fan Power) | 85.5 | 89.4 | 92.1 | 84.8 | 88.0 | 90.1 |

When both the packs constructed in accordance with the 245-APP and the preferred cross corrugated fill pack 10 are compared to the CF1900 fill, it must be noted that the flute angle was reduced from thirty degrees (30°) to twenty degrees (20°) for the packs constructed in accordance with the 245-APP and the preferred cross corrugated fill pack 100. Based on the results in Table 1, the CF1900 had lower pressure drop for the same thermal performance when compared to the packs constructed in accordance with the 245-APP.

The shape of the microstructure 12 of the sheets 10 of the preferred cross corrugated packs 100 impacts the shape of the water surface at the air-water interface during operation. The sharp microstructure of the packs constructed in accordance with the 245-APP creates a Weir effect upstream from the flow of the water film. This effect significantly increases the thickness of the water film (also called water hold-up). The thickness of this fluid film at the 'Weir' of the fill constructed in accordance with the 245-APP sometimes can be much larger than the actual height of the microstructure depending on the water application rate. This increase in fluid film thickness impedes air flow in the fill constructed in accordance with the 245-APP by reducing the cross-sectional area through which the air is allowed to flow between assembled fill sheets. Soft microstructure does not hold up water as it adheres to the surface and, therefore, the air-water interface more closely follows the shape of the microstructure. The artifact of this phenomena is that the thinner more distributed layers of water on the preferred sheets 10 within the fill pack 100 do not generate the thick formation of pockets of water seen on the surface of the sheets of the fill pack constructed in accordance with the 245-APP, thereby creating water holdup. The impedance to airflow is therefore reduced with the softer and arcuate microstructure 12 of the preferred sheets 10 within the fill pack 100, thereby reducing pressure drop of air flowing in the airflow direction 28 through the fill pack 100.

The water application rate onto the preferred cross corrugated fill packs 100, as well as onto the packs constructed in accordance with the 245-APP, impacts the thickness of the water on the surface of the fill packs 100 and the fill pack constructed in accordance with the 245-APP and contributes to differences in thermal performance and pressure drop under differing water loads. The proximity of the adjacent microstructure surfaces (i.e., space between successive horizontal ribs or top ribs) drives the ability of the water to bridge or adhere to both surfaces (inherent in design) and fill in (not inherent in design) on the microstructure. Larger distances break the surface tension of the water and allow for the surfaces of the microstructure 12 to dominate the effective surface area driving a thinner more distributed film and improved mixing within the film based on interface friction with the air and fill surface. The filleted design or relatively smooth and arcuate radii 12*a* of the microstructure 12 of the preferred sheets 10 does not support the bridging of water across the surfaces of the microstructure 12, including the radii 12*a*, the flat strips 12*b* and the conduit sides 12*c*.

Structured sheet fill products, including the preferred cross corrugated fill pack 100, are configured to handle the structural loads applied during installation and while in operation. Typically, the compressive strength of the fill pack 100 in the gauge selected for the application is sufficient based on the configuration of the geometry of the flutes 20 and the microstructure 12. The addition of structural ribs (not shown) in the sheets 10 may be preferred, depending upon the structural performance of the product design, whereas focusing on thermal performance and pressure drop is subject to the application of the product. These structural ribs essentially cut through the microstructure 12 where they may also provide a drain for water to flow directly through the fill pack 100, thereby limiting the water's exposure to the airflow. A small change in thermal performance is expected if structural ribs are incorporated into the preferred sheets 10 for structural integrity for varying fill gauges.

The first and second flute angles $\Delta_{f1}$, $\Delta_{f2}$ of the preferred corrugated fill sheets 10 range from zero to forty-five degrees (0-45°) from a vertical position or relative to the longitudinal axis 14. A microstructure depth A of the microstructure 12 ranges from approximately eight hundredths to twelve hundredths inches (0.08-0.12") or two to three millimeters (2-3 mm). A microstructure height B of the microstructure 12 ranges from approximately two tenths to three tenths inches (0.2-0.3") or five to seven and six tenths millimeters (5-7.6 mm). A microstructure radius D, E of the fillet or radii 12*a* as a percentage of the microstructure depth A ranges from seventy to one hundred percent (70-100%) and generally is not necessarily consistent throughout the sheet 10. The microstructure radius D, E is, therefore, approximately fifty-six thousands of an inch to twelve hundredths inches (0.056-0.12") or one and four tenths to three millimeters (1.4-3 mm) in the preferred embodiment. In addition, a microstructure spacing C between peaks of the microstructure 12 is approximately twice the microstructure height B or approximately four tenths inches to six tenths inches (0.4-0.6") or ten to fifteen millimeters (10-15 mm) in the preferred embodiment. The microstructure depth A, the microstructure height B, the microstructure spacing C and the microstructure radius D, E are not limited to the above-listed dimensions and ranges and may be designed and configured to have different sizes and dimensions based on design requirements, designer preferences and design characteristics, as long as the sheets 10 are able to take on the general preferred configuration, withstand the normal operating conditions and perform the preferred functions described herein.

Figure 2:
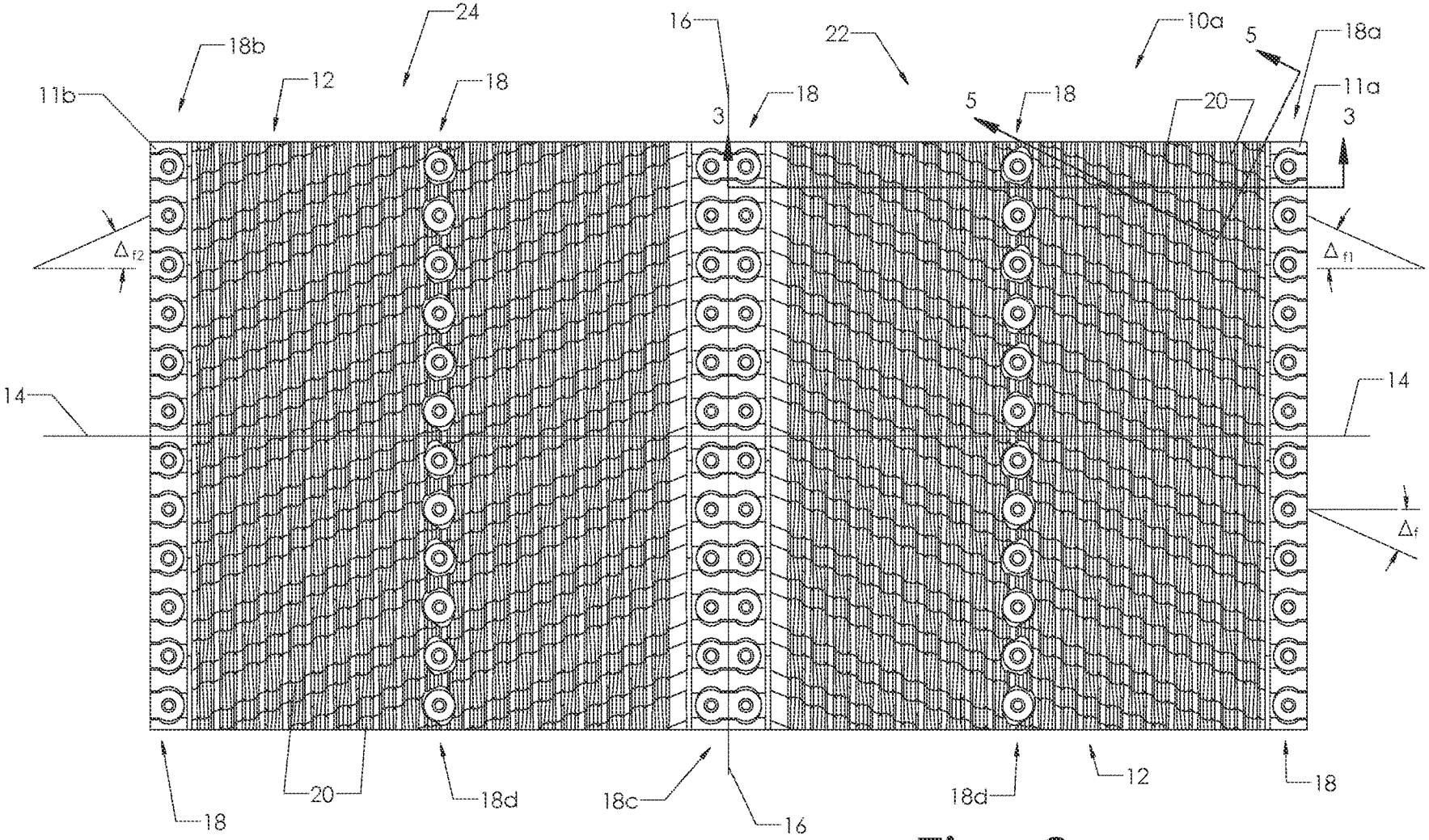
FIG. 2 is a top plan view of a first sheet of the cross corrugated pack of FIG. 1.
Figure 3:
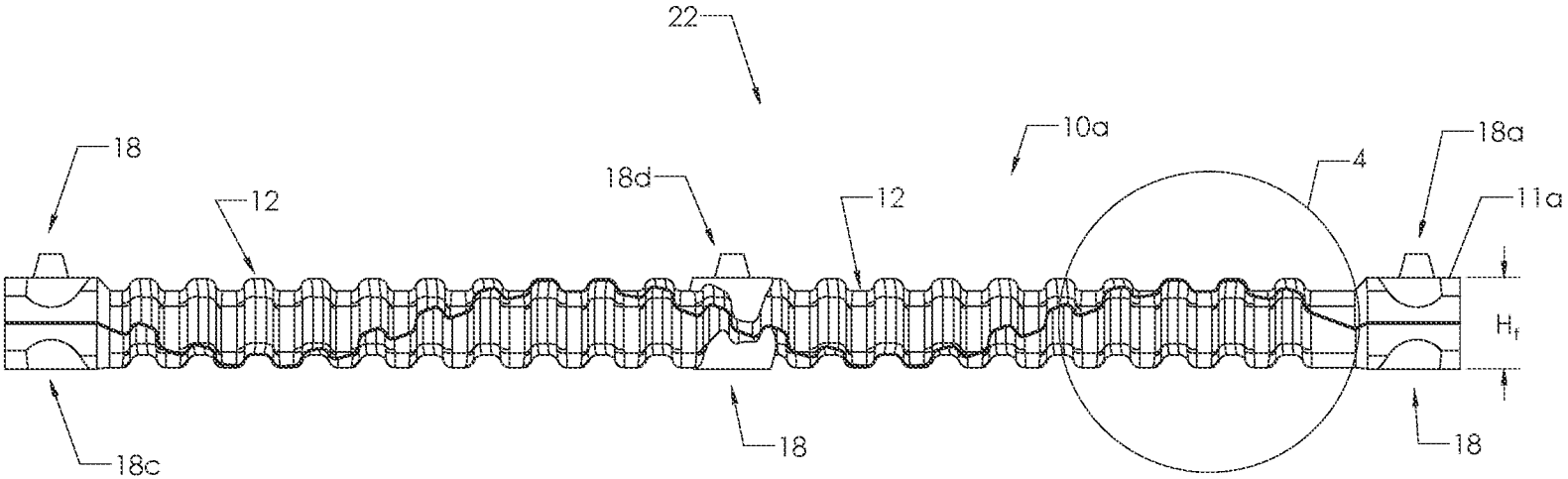
FIG. 3 is a cross-sectional view of the first sheet of FIG. 2, taken along line 3-3 of FIG. 2.
Figure 5A:
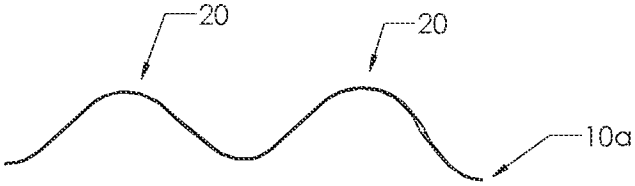
FIG. 5A is a cross-sectional representation of flutes or macrostructure of the first sheet of FIG. 2, taken along line 5-5 of FIG. 2.
Figure 5B:
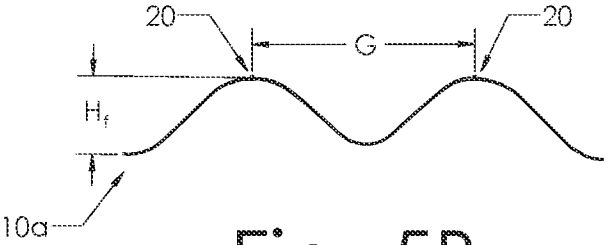
FIG. 5B is a cross-sectional representation of flutes or macrostructure of the first sheet of FIG. 2, taken along line 5-5 of FIG. 2 with added dimensions.

Referring to FIGS. 2, 5A and 5B, the flutes 20 of the preferred embodiment are preferably wavy or have a sinusoidal-like shape taken along a line substantially perpendicular relative to the flutes 20. The flutes 20 have the flute height $H_f$, as described above, and a flute spacing G. The flute spacing G is approximately one-half to three inches (0.5-3") or twelve and seven tenths to seventy-six millimeters (12.7-76 mm) for the preferred sheets 10 and is approximately two inches (2") or fifty-one millimeters (51 mm) for a particularly preferred configuration of the sheet 10.

For these reasons, the design of the preferred cross corrugated media or fill sheets 10 and assembled fill pack 100 is novel, inventive, and has significant commercial value over the existing commodity product offered in the market.

It will be appreciated by those skilled in the art that changes could be made to the preferred embodiment described above without departing from the broad inventive concept thereof. It is understood, therefore, that this invention is not limited to the particular embodiment disclosed, but it is intended to cover modifications within the spirit and scope of the present invention as defined by the present disclosure.

We claim:

1. A cross corrugated fill pack assembly for cooling a fluid flowing through the pack with a gas flowing through the pack in a substantially opposing direction, the fill pack assembly comprising:

a first sheet defining a longitudinal axis and having a first end, a second end and a first plurality of flutes extending from the first end toward the second end, the first plurality of flutes including a first flute, the first plurality of flutes being connected to each other laterally along the longitudinal axis, a first microstructure defined on the first sheet including first top flat strips, first bottom flat strips and first conduit sides connecting the first top flat strips to the first bottom flat strips, a plurality of first arcuate surfaces connecting the first top flat strips to the first conduit sides and the first bottom flat strips to the first conduit sides, the first microstructure continuously extending between lateral edges of the first sheet, the first plurality of flutes extending at a first flute angle relative to the longitudinal axis and guiding the gas flowing through the pack from the first end toward the second end, the first flute angle being approximately zero to forty-five degrees; and a second sheet having a second plurality of flutes, the second plurality of flutes including a second flute, a second microstructure defined on the second sheet including second top flat strips, second bottom flat strips and second conduit sides connecting the second top flat strips to the second bottom flat strips, a plurality of second arcuate surfaces connecting the second top flat strips to the second conduit sides and second bottom flat strips to the second conduit sides, the first and second microstructure extending across the first and second sheets, respectively, perpendicular to the longitudinal axis, the first sheet connected to the second sheet in an assembled configuration with the first plurality of flutes extending to an opposite side of the longitudinal axis relative to the second plurality of flutes such that the first flute crosses the second flute between the first and second ends.

2. The fill pack assembly of claim 1, wherein at least one of the first plurality of flutes extends from the first end to the second end.

3. The fill pack assembly of claim 1, wherein at least one of the first plurality of flutes extends from the first end and terminates before reaching the second end.

4. The fill pack assembly of claim 1, wherein the first plurality of flutes form a sinusoidal-like wave along a cross-section taken along a line substantially perpendicular to a longitudinal direction of the first plurality of flutes.

5. The fill pack assembly of claim 1, wherein the first sheet includes a first portion proximate the first end and a second portion proximate the second end, the first and second portions separated by a central row of connectors.

6. The fill pack assembly of claim 5, wherein the first flute angle includes a first flute angle in the first portion and a second flute angle in the second portion.

7. The fill pack assembly of claim 1, wherein the first top flat strips and the first bottom flat strips are spaced from each other along the longitudinal axis, the second top flat strips and the second bottom flat strips being spaced from each other along the longitudinal axis, the longitudinal axis extending parallel to an airflow direction.

8. The fill pack assembly of claim 1, wherein the first microstructure extends parallel to a lateral axis of the first sheet, the first microstructure extending across the first flute with the first top flat strips and the first bottom flat strips extending parallel to the lateral axis.

9. The fill pack assembly of claim 1, wherein the first top flat strips, the first bottom flat strips and first conduit sides are defined by a cross-section taken along a line extending parallel to the longitudinal axis.

10. The fill pack assembly of claim 1, wherein the first top flat strips and the first bottom flat strips extend parallel to a lateral axis of the first sheet across the first plurality of flutes.

11. The fill pack of claim 1, wherein the plurality of first arcuate surfaces include a plurality of first radii and the plurality of first radii is approximately seventy to one hundred percent of the microstructure depth.

12. The fill pack assembly of claim 1, wherein the plurality of first arcuate surfaces define a plurality of first radii between the first top flat strips and first bottom flat strips.

13. The fill pack assembly of claim 12, wherein a first arcuate surface of the arcuate surfaces is defined by a first microstructure radius and a second microstructure radius, the first microstructure radius being approximately the same as the second microstructure radius.

14. The fill pack assembly of claim 13, wherein the first microstructure radius and the second microstructure radius are approximately one and four tenths to three millimeters (0.4-3 mm).

15. A cross corrugated fill pack assembly for cooling a fluid flowing through the pack with a gas flowing through the pack in a substantially opposing direction, the fill pack assembly comprising:

a first sheet defining a longitudinal axis and having a first end, a second end and a first plurality of flutes extending from the first end toward the second end, a first microstructure defined on the first sheet including first top flat strips, first bottom flat strips and first conduit sides connecting the first top flat strips to the first bottom flat strips, a plurality of first arcuate surfaces connecting the first top flat strips to the first conduit sides and the first bottom flat strips to the first conduit sides, the plurality of first arcuate surfaces defining transitions between the first top flat strips and the first bottom flat strips, the first microstructure continuously extending between lateral edges of the first sheet, the first plurality of flutes extending at a first flute angle relative to the longitudinal axis, the first flute angle being approximately zero to forty-five degrees; and a second sheet having a second plurality of flutes, a second microstructure defined on the second sheet including second top flat strips, second bottom flat strips and second conduit sides connecting the second top flat strips to the second bottom flat strips, a plurality of second arcuate surfaces connecting the second top flat strips to the second conduit sides and second bottom flat strips to the second conduit sides, the first sheet connected to the second sheet in an assembled configuration with the first plurality of flutes extending to an opposite side of the longitudinal axis relative to the second plurality of flutes such that at least one of the first plurality of flutes crosses at least one of the second plurality of flutes between the first and second ends, and the first and second top flat strips and the first and second bottom flat strips are aligned along the longitudinal axis in the assembled configuration, the first and second plurality of flutes guiding the gas flowing through the fill pack from the first end toward the second end.

16. The cross corrugated fill pack assembly of claim 15, wherein the second sheet is rotated one hundred eighty degrees relative to the first sheet to assemble the first and second sheets into the fill pack.

17. The cross corrugated fill pack assembly of claim 16, wherein the first sheet includes a first end row of connectors proximate the first end, a second end row of connectors proximate the second end and a first central row of connectors located centrally between the first and second ends, the second sheet includes a second central row of connectors, the first and second central rows of connectors aligned and connected in the assembled configuration.

18. The cross corrugated fill pack assembly of claim 15, wherein the first and second microstructure extend substantially parallel to a lateral axis of the fill pack.

19. The fill pack assembly of claim 15, wherein the first top flat strips and the first bottom flat strips are spaced from each other along the longitudinal axis, the second top flat strips and the second bottom flat strips being spaced from each other along the longitudinal axis, the longitudinal axis extending parallel to an airflow direction.

20. The fill pack assembly of claim 15, wherein the first top flat strips, the first bottom flat strips and first conduit sides are defined by a cross-section taken along a line extending parallel to the longitudinal axis.

21. The fill pack assembly of claim 15, wherein the first top flat strips and the first bottom flat strips extend parallel to a lateral axis of the first sheet across the first plurality of flutes.

* * * * *